US008741523B2

(12) United States Patent
Hori et al.

(10) Patent No.: US 8,741,523 B2
(45) **Date of Patent: *Jun. 3, 2014**

(54) TONER FOR DEVELOPING ELECTROSTATIC IMAGE AND MANUFACTURING METHOD THEREOF

(75) Inventors: Anju Hori, Tokyo (JP); Noboru Ueda, Tokyo (JP); Hiroshi Nagasawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 278 days.

This patent is subject to a terminal disclaimer.

(21) Appl. No.: 13/081,840

(22) Filed: Apr. 7, 2011

(65) Prior Publication Data

US 2011/0256476 A1 Oct. 20, 2011

(30) Foreign Application Priority Data

Apr. 16, 2010 (JP) ..... 2010-094724

(51) Int. Cl.
*G03G 9/08* (2006.01)

(52) U.S. Cl.
USPC ..... 430/110.1; 430/107.1; 430/108.1; 430/108.6

(58) Field of Classification Search
USPC ..... 430/107.1, 108.1, 108.6, 110.1
See application file for complete search history.

(56) References Cited

U.S. PATENT DOCUMENTS

| | | | | |
|---|---|---|---|---|
| 5,318,871 | A * | 6/1994 | Inagaki et al. | 430/110.1 |
| 5,660,963 | A * | 8/1997 | Doujo et al. | 430/109.4 |
| 6,335,137 | B1 * | 1/2002 | Suzuki et al. | 430/110.1 |
| 8,404,419 | B2 * | 3/2013 | Konno et al. | 430/109.1 |
| 2003/0180643 | A1 * | 9/2003 | Suzuki et al. | 430/108.6 |
| 2003/0186148 | A1 * | 10/2003 | Nakamura et al. | 430/107.1 |
| 2005/0158644 | A1 * | 7/2005 | Kondo et al. | 430/108.1 |
| 2009/0068578 | A1 * | 3/2009 | Murakami et al. | 430/105 |
| 2009/0226834 | A1 | 9/2009 | Matsumura | |

FOREIGN PATENT DOCUMENTS

| | | | |
|---|---|---|---|
| JP | 2002-162773 | | 6/2002 |
| JP | 2008-026645 | | 2/2008 |
| JP | 2008-180938 | | 8/2008 |
| JP | 2008180938 | A * | 8/2008 |
| JP | 2009-258453 | | 11/2009 |

OTHER PUBLICATIONS

English translation of JP 2008180938 A, Matsushima et al., Japan, Aug. 2008.*
English translation of claims of JP 2008180938 A, Matsushima et al., Japan, Aug. 2008.*
SIPO Office Action, Application No. 201110097577.5.
English translation of SIPO Office Action, Application No. 201110097577.5.

* cited by examiner

*Primary Examiner* — Mark F Huff
*Assistant Examiner* — Rashid Alam
(74) *Attorney, Agent, or Firm* — Lucas & Mercanti, LLP

(57) ABSTRACT

A toner for developing electrostatic image comprising a toner particle containing a binding resin is disclosed. which, and In the toner the binding resin has a domain-matrix structure composed of a high elastic resin composing a domain and a low elastic resin composing a matrix, an arithmetic mean value of ratio (L/W) of the Length L to Width W of the domains is 1.5 to 5.0, domains having Length L in the range of 60 to 500 nm exist 80 number % or more, and domains having Width Win the range of 45 to 100 nm exist 80 number % or more, in a viscoelastic image of a cross section of the toner particle observed via an atomic force microscope.

17 Claims, 2 Drawing Sheets

TONER FOR DEVELOPING ELECTROSTATIC IMAGE AND MANUFACTURING METHOD THEREOF

This application is based on Japanese Patent Application No. 2010-094724 filed on Apr. 16, 2010, in Japanese Patent Office, the entire content of which is hereby incorporated by reference.

TECHNICAL FIELD

The present invention relates to a toner for developing electrostatic image and a manufacturing method thereof.

BACKGROUND OF INVENTION

In a step of fixing a toner image which have been transferred on a transferee material of an image forming method via electrophotography, a method of passing between rotating heating device and pressing device is widely popularized for fixing a toner image on a transferee material In recent years, investigations of energy saving have been conduced in various fields from a view point of preventing global warming, improvement has been progressed such as realization of stand-by power saving employing less energy in an information device such as an image forming apparatus, and on one side, investigations were conducted in lowering fixing temperature in a fixing process which consumes energy most. The fixing temperature is herein means surface temperature set in a heating device surface temperature.

Technologies have been developed for reducing heat capacity of a heating device in a fixing device to shorten warm-up period for this purpose. Concretely, methods are made popular in which thinning a substrate made of aluminum the heating device or, employing a film or a belt for heating device.

While there is an advantage in the fixing device employing the heating device with reduced heat capacity to shorten warm-up period, surface temperature in a region corresponding to a non-image portion in the heating device may rise in excess, or surface temperature in a region corresponding to an image portion in the heating may fall in excess. There are problems particularly that when size or an image pattern of a transferee material is changed after continuous printing out of same image, hot off-set phenomena occurs in a region of a heating device where surface temperature rises in excess, or fixing strength of an image to be formed becomes lower in a region of a heating device where surface temperature falls in excess (see, for example, Patent Document 1).

There is known technology of introducing component having high elastic modulus into a binding resin of a toner for developing electrostatic image to inhibit occurring hot off-set phenomena, generally. However, there is a problem that high glossiness is not obtained since surface of the image formed by introducing high elasticity component is not smooth.

In recent years, a fixing device employing low heat capacity heating device has been developed to a color image forming apparatus, and high glossiness is required for the image as formed (see, for example, Patent Document 2).

It is general to employ a binding resin having so called a sharp melt property in toner for developing electrostatic image for giving the image high glossiness, however there is a problem that anti-hot off-set property cannot be obtained in wide fixing temperature range.

While low temperature fixing is attained by employing a binding resin having softening point low for toner for developing electrostatic image and energy saving is realized, there is a problem to hot off-set phenomena by lowering thermal physical properties of the toner for developing electrostatic image simply.

As described above, it is difficult to dissolve the three problems of high glossiness, low temperature fixing property and anti-hot off-set property in conventional toner for developing electrostatic image simultaneously.

PRIOR ART DOCUMENT

[Patent Document 1] JP A 2009-258453
[Patent Document 2] JP A 2008-026645

SUMMARY OF THE INVENTION

The invention is accomplished by considering the circumstances described above. The object of the invention is to provide a toner for developing an electrostatic image attaining low temperature fixing property and anti-hot off-set property, as well as forming an image having high glossiness simultaneously, and a manufacturing method of the toner.

The toner for developing electrostatic image of the invention (hereafter, referred also simply to a toner) comprises a toner particle containing a binding resin, wherein in a viscoelastic image of a cross section of the toner particle observed via an atomic force microscope (AFM) (hereafter, referred to "Viscoelastic AFM Image"), the binding resin has a domain-matrix structure composed of a high elastic resin composing a domain and a low elastic resin composing a matrix, an arithmetic mean value of a ratio of (L/W) is in the range of 1.5 to 5.0, wherein L is Length L and W is Width of domains, and domains having Length L in the range of 60 to 500 nm exist 80 number % or more, and domains having Width W in the range of 45 to 100 nm exist 80 number % or more.

It is preferable that an arithmetic mean value of area S of domains is in the range of 0.005 to 0.05 $\mu m^2$ in the Viscoelastic AFM Image in the toner for developing electrostatic image of the invention.

A manufacturing method of the toner for developing electrostatic image of the invention comprises;

a step of preparing dispersion liquid A of resin particles A composed of a low elastic resin for forming the matrix, a step of preparing dispersion liquid B of resin particles B composed of a high elastic resin for forming the domain, in which a resin of the resin particles B has a glass transition point of 60 to 80° C. and softening point of 150 to 200° C., a step of forming aggregated particles by mixing the dispersion A and the dispersion B, and subjecting the resin particles A and the resin particles B to aggregation and fusion, and a step of ripening the aggregated particles in a temperature condition of the neighborhood of the softening point of the resin particles A and lower than the softening point of the resin particles B.

DETAILED DESCRIPTION OF THE INVENTION

Figure 1:
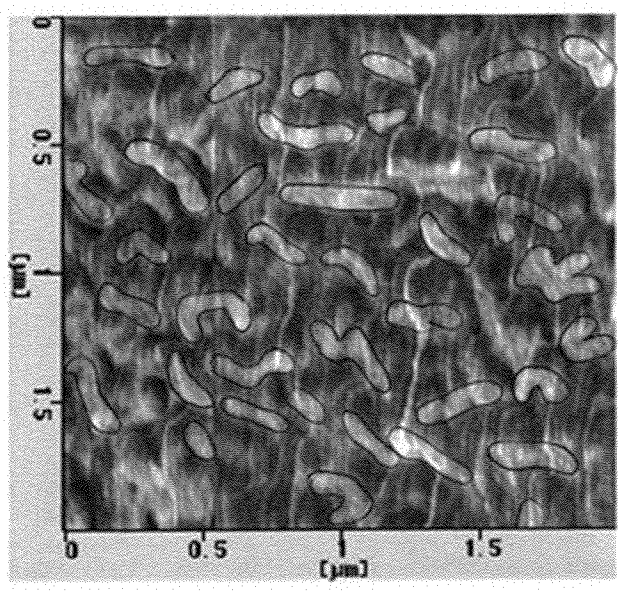
FIG. 1 shows an example of a Viscoelastic AFM Image via AFM of cross section of the toner particle of the toner according to the invention.

The invention is described in detail.

The inventors have studied separation functions with respect to each effect for obtaining high glossiness, realization of low temperature fixing property and preventing hot off set phenomena, and have approached to preparation of toner composed of a resin having low softening point and low elasticity from a view point of high glossiness and low temperature fixing property and a resin having high elasticity from a view point of an anti-hot off-set property. However, sufficient effects have not been obtained by control of the toner particle structure employing conventional technology. Therefore toner has been manufactured by orientation method of domain-matrix structure resins, and high glossiness can be obtained but anti-hot off-set property was not sufficient by making size of domain having spherical shape smaller than the wavelength of visible light.

The inventors have solved the problems of the invention by employing a toner composed of a binding resin to which domains having a rod like shape, stipulated in this invention, (hereafter, referred to "specific shape"), are introduced.

The binding resin incorporated in the toner particles composing the toner has domain-matrix structure composed of resins having different elasticity, and, the domain has the specific shape, and therefore, an image obtaining low temperature fixing property as well as anti-hot off-set property and having high glossiness can be formed, according to the toner according to the invention.

The reason for obtaining low temperature fixing property despite of obtaining anti-hot off-set property is assumed as follows.

Generally, the system existing plural resins having different thermal physical properties shows averaged thermal physical properties by an interaction between the resins. However, thermal physical properties between the low elastic resin composing matrix (hereafter, referred also to "matrix resin.") and the high elastic resin composing domain (hereafter, referred also to "domain resin") is different so much in the binding resin according to the invention, there is no interaction between matrix resin and domain resin at the lower side of the fixing temperature, and only matrix resin which has low softening point melts but domain, resin does not concern melting, therefore domain resin does not inhibit deformation of toner by melting. Therefore it is assumed that the toner has low temperature fixing property as well as anti-hot off-set property.

Further, one of the causes generating hot off-set phenomena is that elasticity of molten toner falls within fixing parts, and fixing performance between the molten toner and a transferee material reduces. That is, the toner in, a molten state is drawn from both sides of surface of the fixing parts and the surface of a transferee material, however, the doman having the specific shape composed of the high elastic resin exhibits elasticity by a moment oriented to coincide the long axis to drawn direction from the random arranged state, and further, the anti-off set property is displayed in the toner by that repulsive elasticity concentrates to force drawn from surface of the fixing parts, after the orientation of the long axis of domain, according to the invention.

Further, the reason why the high glossiness can be obtained is assumed that surface of the image to be formed is restrained to have roughness not to generate irregular reflection of visible light, since the domain has a specific size less than the wavelength of the visible light.

Toner for Developing Electrostatic Image

The toner according to the invention is composed of toner particles containing a binding resin having domain-matrix structure.

The toner according to the invention may contain an inner additive such as a coloring agent, a releasing agent and a charge controlling agent in addition to a binding resin inside of the toner particle according to necessity.

It is preferable that the toner according to the invention has a glass transition point of 25 to 55° C., and more preferably 30 to 45° C.

Glass transition point of the toner can be measured by employing a differential scanning calorimeter "Diamond DSC" (product by PerkinElmer Co., Ltd.). More specifically, 4.5 to 5.0 mg of a releasing agent is precisely weighed to two decimal places and enclosed in an aluminum pan, and then set onto a DSC-7 sample holder. Measurement for reference was performed using an empty aluminum pan. Controlled temperature of a heat-cool-heat cycle is carried out under measuring conditions of a measurement temperature of 0 to 200° C., a rate of temperature increase of 10° C./min, and a rate of temperature decrease of 10° C./min, after which analysis was conducted based on the data of the 2nd heat. A glass transition point Tg is obtained as a value which is read at the intersection of the extension of the base line, prior to the initial rise of the first endothermic peak, with the tangent showing the maximum inclination between the initial rise of the first peak and the peak summit.

It is preferable that a softening point the toner is 90 to 110° C., and more preferably 95 to 105° C.

When softening point of the toner is too low, it is possible to cause hot off-set phenomena, on the other side, when softening point of the toner is too high, it is possible that the image to be formed does not have sufficient fixing strength.

Herein, the softening point temperature of color toner is measured as described below. First, after placing 1.1 g of color toner in a Petri dish to be flattened out, and standing for at least 12 hours at 20±1° C. and 50% RH, a pressure of 3,820 kg/cm$^2$ is applied for 30 seconds employing a molding machine "SSP-10A" (produced by Shimadzu Corp.) to prepare a 1 cm diameter cylindrical molding sample. Next, the resulting sample is extruded from a cylindrical die hole (1 mm in diameter×1 mm) employing a 1 diameter piston after termination of pre-heating under the conditions of an applied load of 196 N (20 kgf), a starting temperature of 60° C., pre-heating time of 300 sec., and a temperature raising rate of 6° C./minute, by using a flow tester "CFT-500D" (produced by Shimadzu Corp.) at 24° C. and 50% RH, and offset method temperature $T_{offset}$ measured on the basis of melting temperature determination of the temperature raising method with setting at an offset value of 5 mm is designated as a softening point temperature of the toner.

A volume based median diameter of toner particles composing the toner is 3 to 12 μm, and preferably 4 to 9 μm. When volume based median diameter of the toner particle is within the above described range, a high quality image can be formed.

The volume-based median particle diameter of toner is determined and calculated employing a measuring device in which a data processing computer system with "Software V3.51" (produced by Beckman Coulter Inc.) is connected to "COULTER MULTISIZER III" (produced by Beckman Coulter Inc.).

It is preferable that the toner particles composing toner has an average circularity of 0.930 to 1.000, and more preferably 0.950 to 0.995, from a view point of improving transfer efficiency.

The average circularity of toner particles can be measured by employing "FPIA-2100" (produced by Sysmex Corp.). Specifically, the toner is wetted with an aqueous solution containing a surfactant, followed by being dispersed via an ultrasonic dispersion treatment for one minute, and thereafter the dispersion of toner particles is photographed with "FPIA-2100" (manufactured by Sysmex Corp.) in an HPF (high magnification photographing) mode at an appropriate density of the HPF detection number of 3,000-10,000 as a measurement condition. The circularity of each toner particle is calculated according to Formula (T) described below. Then, the average circularity is calculated by summing the circularities of each of the toner particles And dividing the resulting value by the total number of the toner particles. The HPF detection number falling within the above-described range makes it possible to realize reproduction.

Circularity=(circumference of a circle having an area equivalent to a projection of a particle)/(circumference of a projection of a particle) Formula (T)

Binding Resin

The binding resins contained in the toner particles composing toner form a domain-matrix structure composed of a high elastic resin and a low elastic resin.

In the domain-matrix structure of the invention domains which are a region composed of the high elastic resin having higher elasticity than the resin composing matrix are formed in a continuous matrix phase composed of the low elastic resin.

The binding resin of the domain-matrix structure is specifically made in a state that domains having the specific shape (a light portion) composed of the domain resin are dispersed in a matrix (a dark portion) composed of the matrix resin as shown in FIG. 1.

The binding resin of the domain-matrix structure can be confirmed by employing an atomic force microscope (AFM) SPM(SPI3800N) (produced by Seiko Instruments Inc.) with respect to cross section of the toner particle.

Practically, a toner particle humidity controlled in a circumstance of temperature at 20° C. and humidity of 50% RH is embedded in a UV curable resin and cured for 24 hours, and then is cut out via a ultramicrotome "MT-7" (produced by RMC) to prepare the sample for surface observation. The sample is observed via an atomic force microscope (AFM) SPM(SPI3800N) with a cantilever SN-AF01, (both produced by Seiko Instruments Inc.), for a region of 2 μm square in Viscoelasticity Mode at room temperature.

A toner particle containing no inner additive such as a coloring agent and a releasing agent was used for Viscoelastic AFM Image shown in FIG. 1 for the purpose of confirming the dispersion state of a binding resin of domain-matrix structure. A Viscoelastic AFM Image is observed similar to the Viscoelastic AFM Image shown in FIG. 1 in a region which is not affected by an inner additive such as a coloring agent and a releasing agent in the toner particle.

(Domain)

A domain resin in the domain-matrix. structure is not particularly restricted, and includes, for example, a styrene-acrvl resin, and a (meth)acrylic acid ester copolymer, Preferable example is a (meth)acrylic acid ester copolymer, particularly coDolvmer of methylmethacrylate, butylacrylate and itaconic acid as it is easy to control the shape of domains.

It is preferable that storage elastic modulus of the domain resin at 100° C. is $4.0\times10^5$ to $1.0\times10^8$ dyn/cm$^2$ from a view point of obtaining three benefits of anti-hot-off-set property, low temperature fixing property and high glossiness.

Storage elastic modulus of the domain resin at 100° C. can be measured and calculated by the following measuring apparatus, condition and procedure.

Measuring apparatus: MR-500 SOLIQUIDMETER (produced by Rheology Co.)

Measuring Condition:

Frequency: 1 Hz

Measuring Mode: temperature dispersion

Measuring Jig: parallel plate having diameter of 0.997 cm

Measuring Procedure:

(1) Under the condition of temperature 20±1°C, humidity 50±5% RH, 0.6 g of domain resin. (resin, particles) is put in a Petri dish and leveled, after keeping stand for over 12 hours, and is nressed via a pressing device "SSP-10A" (Produced by Shimadzu Corp.) with a force of 3,820 kg/cm$^2$ for 30 sec., and cylindrical toner pellet having diameter of 1 cm, height of 5 to 6 mm is prepared, (2) The toner pellet is charged in parallel plate equipped to measuring apparatus.

(3) Temperature of the measuring portion is adjusted 50 C. lower than the softening point of domain resin, and then parallel plate is adjusted to 3 mm.

(4) Temperature of the measuring portion is cooled down to measuring starting temperature 35° C., then temperature of the measuring portion is raised. to 200° C. at a rate of 2° C./min. while apnlying cosine wave vibration, of frequency of 1 Hz, and storage elastic modulus is measured at determined temperature (100° C.).

The storage elastic modulus of domain resin can be controlled by selecting resin components, molecular weight and so on of the domain resin. Molecular weight of the domain resin can be controlled by regulating an amount of a chain transfer agent used in preparation step of dispersion liquid B of resin particles B composed of domain resin (step (b)), in the manufacturing method of the toner described later.

An arithmetic mean value of ratio (L/W) of the Length L to Width W of the respective domain in a Viscoelastic AFM Image of 2 μm square obtained by a method described above is within a range of 1.5 to 5.0, more preferably within a range of 1.7 to 4.2.

Figure 2A:
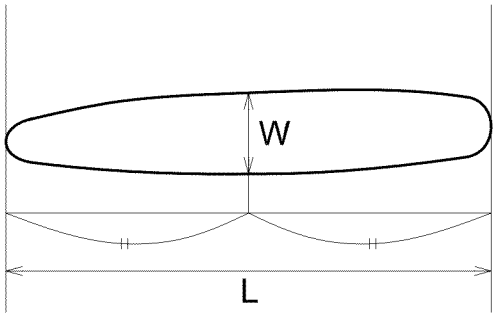
FIGS. 2*a* and 2*b* show a schematic figure illustrating Length L and Width W of a domain.
Figure 2B:
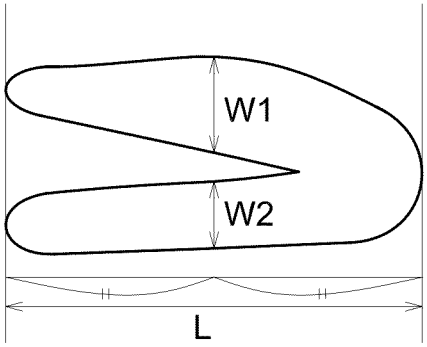

Length L of the domain is the maximum distance of the two parallel lines when contour line is put into two parallel lines wherein contour line of domain is drafted in the Viscoelastic AFM Image having 2 μm square obtained by the above described method (see FIG. 1), and Width W of the domain is a distance between two points crossing the perpendicular bisector of Length L and contour line of the domain (see FIG. 2*a*). When there are two or more line segments corresponding to Width W, the shortest one is defined as Width W. Practically, the perpendicular bisector of Length L and contour line of the domain crosses at four points to form W1 and W2 as shown in FIG. 2*b*, one of the shorter one is defined as Width W.

Viscoelastic AFM Image in FIG. 1 is shown in a state that noise caused by the height signal is cut by referring to height image within the same range when the contour of domain is drafted.

Domains having Length L in the range of 60 to 500 nm exist 80 number % or more, and, domains having Width W in the range of 45 to 100 nm 80 number % or more exist in the Viscoelastic AFM Image having 2 μm square obtained by the above described method.

An image having high glossiness can be formed when domains satisfying above described range of Length L and Width W, in the Viscoelastic AFM Image having 2 μm square exist 80 number % or more.

An image having high glossiness cannot be obtained, and further, sufficient low temperature fixing property and anti-hot off-set property are not obtained when domains satisfy the above described range of Length L and Width W are 80 number % or less, respectively. Specifically, in case that Length L of the domain exceeds 500 nm, or Width W exceeds 100 nm, an image having high glossiness cannot be formed, and, sufficient low temperature fixing property is not obtained. On the other side, when Length L of the domain is not more than 60 nm, or, Width W is not more than 45 nm, sufficient anti-off set property is not obtained.

Width W of the domain can be controlled by adjusting particle diameter of resin particles B composed of domain resin in the manufacturing method (step (b)) of the toner described later.

Particle diameter of the resin particles B can be controlled by adjusting an amount of the surfactant used during manufacturing step, preferably in emulsion polymerization step.

Further, Length L of the domain can be controlled by adjusting ratio (MID) of addition amount M of the resin particles A composed of matrix resin to addition amount D of the resin particles B composed of domain resin in a manufacturing method (step (d)) of the toner described later. Specifically, it is preferable that the ratio (M/D) is adjusted within a range of the following Formula (1).

$$70/30 \leq M/D \leq 95/5 \quad \text{Formula (1)}$$

Further, it is preferable that an arithmetic mean value of each domain area S in the Viscoelastic AFM Image having 2 μm square obtained by the above described method is in the range of 0.005 to 0.05 $\mu m^2$, and more preferably in the range of 0.01 to 0.05 $\mu m^2$.

When an arithmetic mean value of each domain area S is within the range described above, domains are dispersed in the matrix with an adequate size, and an image having high glossiness can be formed, as well as low temperature fixing property and anti-hot off-set property are obtained simultaneously.

In case that an arithmetic mean value of domain area S is less than 0.005 $\mu m^2$, there is possibility not to obtain sufficient low temperature fixing property. On the other side, in case that an arithmetic mean value domain area S exceeds 0.05 $\mu m^2$, there is possibility not to form an image having high glossiness.

The domain area S is calculated by the following Formula (2).

$$S(\mu m^2)=(L\times W)-\{W^2-\pi(\tfrac{1}{2}W)^2\} \quad \text{Formula (2)}$$

A glass transition point of domain resin is 60 to 80° C., and preferably 63 to 68° C., from a view point of controlling Length L and Width W of the domain.

The glass transition point domain resin can be measured by employing a differential scanning calorimeter "Diamond DSC" (produced by PerkinEliner Co., Ltd.). Practically, 4.5 to 5.0 mg of domain resin (resin particles composed of domain resin) is precisely weighed to two decimal places and enclosed in an aluminum pan, and then set onto a DSC-7 sample holder. Measurement for reference was performed using an empty aluminum pan. Controlled temperature of a heat-cool-heat cycle is carried out under measuring conditions of a measurement temperature of 0 to 200° C., a rate of temperature increase of 10° C./min, and a rate of temperature decrease of 10° C./min, after which analysis was conducted based on the data of the 2nd heat. A glass transition point Tg is obtained as a value which is read at the intersection of the extension of the base line, prior to the initial rise of the first endothermic peak, with the tangent showing the maximum inclination between the initial rise of the first peak and the peak summit.

A softening point of domain resin is 150 to 200° C., and more preferably 170 to 190° C.

In case that the softening point of the domain resin is within the above described range, anti-hot off-set property can be obtained.

Herein, the softening point of the domain resin is measured as described below. First, after placing 1.1 g of the domain resin (resin particles composed of domain resin) in a Petri dish to be flattened out, and standing for at least 12 hours at 20° C. and 50% RH, a pressure of 3,820 kg/$cm^2$ is applied for 30 seconds employing a pressing machine "SSP-10A" (produced by Shimadzu Corp.) to prepare a 1 cm diameter cylindrical molding sample. Next, the resulting sample is extruded from a cylindrical die hole (1 mm in diameter×1 mm) employing a 1 cm diameter piston after termination of preheating under the conditions of an applied load of 196 N (20 kgf), a starting temperature of 60° C., and preheating time of 300 seconds, a temperature raising rate of 6° C./minute, by using a flow tester "CFT-500D" (produced by Shimadzu Corp.) at 24° C. and 50% RH, and offset method temperature $T_{offset}$ measured on the basis of melting temperature determination of the temperature raising method with setting at an offset value of 5 mm is designated as a softening point temperature of the color toner.

It is preferable that a standard polystyrene converted weight average molecular weight (Mw) of domain resin is 100,000 to 350,000, and more preferably 250,000 to 300,000 from a view point of obtaining a sufficient fixing temperature range.

A standard polystyrene converted weight average molecular weight (Mw) can be measured by gel permeation chromatography. The molecular weight determination via the GPC is carried out as described below. Using an apparatus of HLC-8220 (manufactured by Tosoh Corp.) and a triple column of TSKguardcolumn+TSKgeI Super HZM-M 3 series (manufactured by Tosoh Corp.), tetrahydrofuran (THF) as a carrier solvent is poured at a flow rate of 0.2 ml/min, while holding the column temperature at 40° C. The core particles are dissolved in tetrahydrofuran to a density of 1 mg/ml at a condition of dissolving the core particles at room temperature over five minutes using an ultrasonic homogenizer. Subsequently, the resulting solution is forced through membrane filters of a pore size of 0.2 mm to obtain a sample solution followed by injection of 10 μl of the sample solution into the apparatus together with the above carrier solvent, and then, detection is carried out using a refractive index detector (RI detector). The molecular weight distribution of the measurement sample is calculated using a calibration curve measured using a calibration curve measured using monodispersed polystyrene standard particles. Ten standard polystyrene samples are measured to prepare a calibration curve.

Content ratio of domain resin is preferably 2.5 to 30% by mass, and more preferably 2.5 to 15% by mass with respect to whole amount of the binding resin.

Low temperature fixing property can be maintained in case that content ratio of domain resin is within the range described above.

(Matrix)

Matrix resin composing the binding resin of the domain-matrix structure is not particularly restricted, and adequate one can be employed in accordance with the required properties as a toner such as glossiness and fixing performance, and example thereof includes a polyester resin and a styrene-acryl resin.

It is preferable that storage elastic modulus of matrix resin at 100° C. is $1.0\times10^2$ to $1.0\times10^4$ dyn/$cm^2$.

In case that the storage elastic modulus of matrix resin at 100° C. is less than $1.0\times10^2$ dyn/$cm^2$, there is a possibility of reducing anti-hot-off-set property. On the other side, in case that the storage elastic modulus of matrix resin at 100° C. excess $1.0\times10^4$ dyn/$cm^2$, there is a possibility of not obtaining a sufficient low temperature fixing property.

A glass transition point of the matrix resin is 25 to 50° C. and preferably 30 to 40° C., from a view point of maintaining a low temperature fixing property.

A softening point of the matrix resin is 80 to 120° C., and preferably 90 to 100° C. from a view point of maintaining high glossiness.

Standard polystyrene converted weight average molecular weight (Mw) of the matrix resin is preferably 10,000 to 30,000 and more preferably 15,000 to 25,000 from a view point of obtaining a sufficient fixing available temperature range.

Methods for measuring the storage elastic modulus, the glass transition point, the softening point and the weight average molecular weight (Mw) of the matrix resin are same as measuring methods of the storage elastic modulus, the glass transition point, the softening point and the weight average molecular weight (Mw) of domain resin except that the samples to be measured is replaced by the matrix resin (resin particles composed of matrix resin).

The binding resin is composed of the high elastic resin composing domain and the low elastic resin composing matrix, and these resins may contains at least one kind of other resins than the high elastic resin or the low elastic resin.

Coloring Agent

Coloring agents used in the toner particles composing toner include those commonly usable dyes and pigments.

Various known coloring agents such as carbon black, magnetic material, a dye and an inorganic pigment including non-magnetic iron oxide are arbitrarily available for a black toner.

Various known coloring agents such as a dye and an organic pigment are arbitrarily available for a color toner.

Two or more kinds of colorants can be used in combination for obtaining each color.

Content of the coloring agents is preferably 1 to 10% by mass in the toner, and more preferably 2 to 8% by mass. Tin case that the content of the coloring agent is less than 1% by mass in the toner, there is a possibility that the toner has insufficient coloring power, and on the other side, in case that the content of the coloring agent is excess 10% by mass in the toner, there is a possibility that a coloring agent releases and adheres to carrier, and affects to charging performance.

Releasing Agent

A releasing agent used for the toner particles composing toner is not particularly restricted, and includes, for example, a polyethylene wax, an oxide type polyethylene wax, a polypropylene wax, an oxide type polypropylene wax, a carnauba wax, a SASOL wax, a rice wax, a candelilla wax and behenyl behenate.

A content ratio of a releasing agent in toner particles is usually 0.5 to 25 parts by mass, preferably 3 to 15 parts by mass of based on 100 parts by mass of a binding resin.

Charge Control Agent

As a charge control agent used in the toner particles composing toner, various known compounds such as metal complex, ammonium salt and calixarene can be used.

A content ratio of a charge control agent in toner particles is usually 0.1 to 10 parts by mass, and preferably 0.5 to 5 parts by mass based on 100 parts by mass of a binding resin.

External Additive

The toner particles composing toner can be used as a toner by themselves, and may be used in a state that an external additive such as a fluidity improving agent and a cleaning aid is added to the toner particle for improving fluidity, charging performance and cleaning ability.

The fluidity improving agent includes, inorganic microparticles for example, silica, alumina, titanium oxide, zinc oxide, iron oxide, copper oxide, lead oxide, ammonium oxide, yttrium oxide, magnesium oxide, barium titanate, ferrite, red iron oxide, magnesium fluoride, silicon carbide, boron carbide, silicon nitride, zirconium nitride, magnetite, and magnesium stearate.

It is preferable that the inorganic microparticles is subjected to surface treatment by silane coupling agent, titanium coupling agent, higher aliphatic acid and silicone oil to improve dispersion performance on a surface of the toner particles and environmental stability.

The cleaning aid includes, for example, polystyrene microparticles and polymethylmethacrylate microparticles.

Various external additives may be used in combination.

Addition amount of the external additives as a whole is 0.1 to 20% by mass in the toner.

Developer

The toner according to the invention can be used as a magnetic or non-magnetic one component developer, as well as a two component developer by blending a carrier. When the toner according to the invention is used as a two component developer, magnetic material composed of known material such as metal (iron, ferrite, and magnetite) and alloy of the metal with aluminum, or lead, and ferrite is particularly preferable as a carrier. As the carrier, a coated carrier which is obtained by coating a surface of magnetic particles with covering material such as a resin, or a dispersed type carrier obtained by dispersing magnetic microparticles in a binder resin may be used.

The volume average particle diameter based median diameter of the magnetic particles is preferably from 15 to 100 μm. and is more preferably from 20 to 80 μm. The volume average particle diameter of a carrier can be measured representatively by a laser-diffraction-type particle diameter distribution measuring apparatus equipped with a wet-type dispersion machine "HELOS" (manufactured by SYMPATEC Corp.).

Examples of the preferable carriers include a resin coated carrier in which surface of magnetic particles is coated with a resin and resin dispersed carrier in which magnetic particles are dispersed in a resin. Resins composing resin coated carrier are not particularly limited, and include, for example, an olefin series resin, a styrene series resin, a styrene-acryl series resin, a silicone series resin, an ester series resin and a fluorine-containing polymer resin. Resins composing resin dispersed carrier are not particularly limited, and known resin such as a styrene-acryl resin, a polyester resin, a fluorine resin and a phenol resin are available.

(Manufacturing Method of Toner)

A method for manufacturing the toner is not particularly limited as far as toner particles containing a binding resin composed of domains having the specific shape composed of domain resin dispersed in a matrix composed of a matrix resin are obtained. Preferable are an emulsion polymerization aggregation method, and a mini emulsion polymerization aggregation method and the like as a domain resin can be easily introduced in a matrix resin.

An example of manufacturing methods of the toner according to the invention includes practical steps (a) to (h) of the emulsion polymerization aggregation method, (a) A step of preparing dispersion liquid A of resin particles A composed of the low elastic resin for composing matrix.

(b) A step of preparing dispersion liquid B of resin particles B composed of the high elastic resin for composing domains, wherein the resin has a glass transition point of 60 to 80° C. and softening point of 150 to 200° C.

(c) A step of preparing dispersion liquid X of microparticles of a coloring agent (hereafter, referred also to "coloring agent microparticles").

(d) A step of forming aggregated particles by mixing dispersion liquid A, dispersion liquid B and dispersion liquid X, and making resin particles A, resin particles B and coloring agent microparticles to aggregate and fuse in aqueous medium.

(e) A step of forming a shell layer by adding particles for shell.

(f) A step of ripening to control domain matrix structure by continuing stirring at a temperature of a neighborhood of the softening point a resin particles A and lower than the softening point of the resin particles B.

(g) A step of filtering and washing wherein aggregated particles are separated by filtering from dispersion system of aggregated particles (aqueous medium), and surfactant and the like are removed from aggregated particles.

(h) A step of drying the washed aggregated particles to obtain toner particles.

The shelling step (e) is carried out if necessary.

The water based medium means one in which from 50 percent or more by weight of water, is incorporated. Herein, components other than water may include water-soluble organic solvents. Listed as examples are methanol, ethanol, isopropanol, butanol, acetone, methyl ethyl ketone, tetrahydrofuran, and the like, and alcohol type organic solvents which do not dissolve obtained resin, are preferable.

Step (a)

Resin particles A can be manufactured by an emulsion polymerization method, a seed polymerization method or a mini-emulsion polymerization method, employing radical polymerizable monomers as raw materials. Further, they can be manufactured by a phase inversion emulsifying method in which resin solution employing an organic solvent is subjected to phase inversion emulsification in an aqueous medium.

Resin particles A can be composed of two or more layers each having different a resin component. In this instance, Resin particles A can be manufactured by adding a polymerization initiator and polymerizable monomers to dispersion liquid resin particles prepared by a conventional method of an emulsion polymerization process (1st step polymerization), and subjecting this system to polymerization process (2nd step polymerization).

Particle diameter of the resin particles A is preferably in the range of 45 to 350 nm and more preferably in the range of 45 to 210 nm in volume based median diameter.

Volume based median diameter resin particles A can be measured via MICROTRAC UPA-150 (produced by Nikkiso Co., Ltd.) on a measurement sample prepared by dripping several drops of a sample in a measuring cylinder, adding deionized water thereto and dispersing via a ultrasonic cleaner US-1 (produced by AS ONE Corp.).

A glass transition point of a resin composing resin particles A is 25 to 50° C., and preferably 30 to 40° C. A softening point of resin particles A is 80 to 120° C. and preferably 90 to 100° C.

(Polymerization Initiator)

As for polymerization initiator used in Step (a) water-soluble radical polymerization initiators may be optionally employed. For example, are listed persulfate salts such as potassium persulfate and ammonium persulfate, azo compounds such as 4,4'-azobis-4-cyano valefic acid and its salt, 2,2'-azobis(2-amodinopropane) salt, and peroxide compounds.

(Chain Transfer Agent)

Usually employable chain transfer agents can be used for adjusting molecular weight of the resin particles A in the Step (a). The chain transfer agent is not particularly restricted, and includes mercaptans such as 2-chloroethanol, octyl mercaptan, dodecyl mercaptan and t-dodecyl mercaptan, and styrenedimer.

(Surfactant)

Surfactants can be added to disperse resin particles A stably in the step (a). Various surfactants may be employed without restriction. Preferable examples thereof is ionic surfactants which include a sulfonic acid salt such as sodium polyoxy(2) dodecylether sulfonic ether salt, sodium dodecylbenzenesulfonate and sodium arylalkyl polyether-sulfonate; sulfates such as sodium dodecylsulfonate, sodium tetradecylsulfonate, sodium pentadecylsulfonate and sodium octylsulfonate; aliphatic acid salt such as sodium oleate, sodium laurate, sodium caprylate, sodium caprate, sodium caproate, potassium stearate and calcium oleate.

Further available are nonionic surfactants such as polyethylene oxide, polypropylene oxide, combination of polyethylene oxide and polypropylene oxide; ester of polyethylene glycol and higher aliphatic acid; alkylphenol polyethylene oxide; ester of higher aliphatic acid and polyethylene glycol; ester of higher aliphatic acid and polypropylene oxide; and sorbitan ester.

The surfactant described above can be used one kind or two or more in combination as required.

Step (b)

Resin particles B can be manufactured by a emulsion polymerization method, a seed polymerization method or a mini emulsion polymerization method, using radical polymerizable monomers as raw materials. Further, they can be manufactured by a phase inversion emulsifying method in which resin solution employing an organic solvent is subjected to phase inversion emulsification in an aqueous medium.

A particle diameter of resin particles B is preferably in the range of 30 to 140 nm and more preferably in the range of 45 to 100 nm in volume based median diameter.

The volume based median diameter of resin particles B can be measured in same method as the measuring method of volume based median diameter of the resin particles A except that measurement sample is replaced with resin particles B.

A glass transition point of the resin particles B is 60 to 80° C. and preferably 63 to 68° C. A softening point of the resin particles B is 150 to 200° C. and preferably 170 to 190° C.

A polymerization initiator, a chain transfer agent and a surfactant used in Step (b) can be the same as those used in Step (a).

Step (c)

A particle diameter of the coloring agent microparticles is preferably in the range of 10 to 300 nm in volume based median diameter.

The volume based median diameter of the coloring agent microparticles can be measured in the same method as measuring method of above described volume based median diameter of resin particles A except that measurement sample is replaced with a coloring agent microparticles.

Step (d)

It is preferable that aggregation temperature is set not lower than glass transition point of the resin particles A in Step (d), whereby resin particles A are aggregated and simultaneously fused, and aggregated particles are obtained by fusing resin particles Band the coloring agent microparticles.

Length L of the domain can be controlled by adjusting adding amount ratio of resin particles A to resin particles B in Step (d). Practically, it is preferable that ration (MID) of addition amount M of the resin particles A to addition amount D resin particles B is adjusted within a range of Formula (2).

$$70/30 \leq M/D \leq 95/5 \qquad \text{Formula (2)}$$

Aggregation commences with addition of aggregation agent and raising temperature in the Step (d).

(Aggregation Agent)

Aggregation agents used in Step (d) include, for example, alkali metal salts and alkali earth metal salts. The alkali metals composing aggregation agents include lithium and potassium and sodium, alkali earth metals include magnesium, calcium, strontium and barium. Preferable are potassium, sodium, magnesium, calcium and barium among these. Anions forming counter ion to the above described alkali metals or alkali earth metal (an anion forming a salt) include chloride ion, bromide ion, iodide ion, carbonate ion and sulfate ion.

A binding resin of a domain-matrix structure is formed by aggregation and fusion of resin particles A and resin particles B in a manufacturing method of the toner according to the invention. It is preferable that a core part is made of the domain-matrix structure, and a resin having different components from the domain resin and the matrix resin (hereafter, a resin for forming a shell) is formed in a shell layer state outside of the core.

Step (f)

Aggregated particles are ripened in the neighborhood of softening point of resin particles A and not higher than softening point of resin particles B in Step (f). Length L of the domain can be controlled by that a step of ripening step of the aggregated particles is carried out. The neighborhood of softening point of the resin particles A temperature is preferably within a range of softening point of the resin particles A±10° C.

In Step (f), orientation of resin particles B having not been dissolved completely proceeds gently in matrix resin caused from resin particles A with relatively lowered viscosity, after resin particles A and resin particles B are once aggregated and fused. In particular, it is assumed that domain forms specific shape in the ripening step wherein aggregated particles are ripened under the temperature condition of not lower than the glass transition point and not higher than the softening point of resin particles B. Herein, it is assumed that one to several (specifically, 2 to 4) particles of the resin particles B are fused as they are arrayed on a line, and form domains having specific shape in Step (f).

The ripening step is practically carried out by continuing stirring with heating within a temperature described below.

The ripening temperature is preferably at 60 to 97° C. and more preferably 70 to 90° C. The ripening time is preferably 1 to 6 hours from the view point controlling specific shape of domain.

Step (g) to Step (h)

These steps are carried out according to conventional steps.

In case that an inner additive is incorporated in a toner particle, dispersion liquid of inner additive microparticles composed solely of the inner additive is prepared, for example, prior to Step (d), dispersion liquid and dispersion liquid of the inner additive microparticles are mixed in Step (d), and the inner additive microparticles are aggregated with resin particles A, resin particles B and a coloring agent microparticles, whereby the inner additive can be incorporated in toner particles.

Image Forming Method

The toner according to the invention can be used for an image forming method via general electrophotography.

The binding resin incorporated in a toner particle is composed of domain-matrix structure composed of resins having different elasticity, and the shape of domain is specific shape, whereby an image having low temperature fixing property and anti-hot off-set property, as well high glossiness simultaneously can be obtained by the invention.

EXAMPLE

The invention is described by means of Example in detail.

A volume based median diameter of dispersion particles in dispersion liquid of resin particles and coloring agent microparticles were measured by the following method and condition.

—Measuring Method—

Specifically, the measurement was carried out in the following manner. First, a few drops of a particle dispersion was added into a 50 ml measuring cylinder, 25 ml of deionized water was further added thereto and dispersed for 3 minutes by using an ultrasonic washing machine, US-1 (produced by AS ONE Corp.) to prepare a measurement sample. Into a cell of Microtrac UPA-150 was placed 3 ml of the measurement sample. It was confirmed that the value of Sample Loading was within the range of 0.1 to 100. Measurement was conducted under the following conditions.

Measurement Conditions:

Transparency: Yes

Refractive Index: 1.59

Particle Density: 1.05 mg/cm$^3$

Spherical Particles Yes

Solvent Conditions:

Refractive Index: 1.33,

Viscosity:

High (temp) $0.797\times10^{-3}$ Pa·s

Low (temp) $1.002\times10^{-3}$ Pa·s

The volume average particle size of colored particles forming a toner is represented by a volume-based median diameter (also denoted as d50 diameter), which can be measured and calculated by using Multisizer 3 (made by Beckman Coulter Co.) connected to a computer system for data processing.

The volume based median diameter of the toner particles is measured and calculated by using measuring apparatus Coulter Multisizer 3 (produced by Beckman Coulter Inc.) connected to a computer system for data processing Software V3.51.

The measurement procedure is practically as follows: 0.02 g of toner particles are added to 20 ml of a surfactant solution (for example, a surfactant solution obtained by diluting a surfactant containing neutral detergent with deionized water to a factor of 10 for the purpose of dispersing toner particle) and dispersed by an ultrasonic homogenizer to prepare a toner dispersion. Using a pipette, the toner dispersion is poured into a beaker having ISOTON II (produced by Beckman Coulter Co.) within a sample stand, until reaching a displayed measurement concentration of 8%. Reproducible measuring value can be obtained in this concentration. The particle diameters of 25,000 particles are measured using an aperture of 50 μm and frequency of the particle diameter was calculated by dividing the measuring range of from 1 to 30 μm into 256 divisions, and the particle diameter at 50% from the larger side of the cumulative volume percent is defined as the volume-based median diameter.

Example 1

Step (a-1): Preparation of Dispersion Liquid [A1] of Resin Particles [A1]

(1) First Step Polymerization

A surfactant solution was placed into a 5 L reaction vessel equipped with a stirring unit, a temperature sensor, a cooling pipe and a nitrogen gas inlet, and the interior temperature was raised to 80° C. under while stirring at 230 rpm. The surfactant solution was prepared by using 2 parts by mass of an anionic surfactant (sodium dodecylbenzenesulfonate, SDS) and 2,900 parts by mass of ion-exchanged water. After adding 9 parts by mass of polymerization initiator (potassium persulfate, KPS) to the surfactant solution, a monomer solution composed of 550 parts by mass of styrene, 280 parts by mass of n-butylacrylate methacrylic acid, 45 parts by mass of methacrylic acid, and 14.5 parts by mass of n-octylmercaptan was dripped taking for 3 hours, and after completion of dripping, they were kept for 1 hour at 78° C., and thus Dispersion Liquid [A1] resin particles was prepared.

(2) Second Step Polymerization

A surfactant solution was prepared by dissolving 12 parts by mass of an anionic surfactant (polyoxy(2)dodecylether sulfate ester sodium salt) in 1,100 parts by mass of ion-exchanged water. In a flask equipped with a stirring device, a monomer component material composed of 245 parts by mass of styrene, 95 parts by mass of n-butylacrylate methacrylic acid, 25 parts by mass of methacrylic acid and 4 parts by mass of n-octylmercaptan, and 195 parts by mass of a releasing agent behenyl behenate were added, and they were heated to 85° C. to prepare Monomer Solution [2].

To surfactant solution heated to 90° C., 260 parts by mass of Dispersion Liquid [A1] of resin particles and Monomer Solution [2] were added, and were mixed and dispersed via a mechanical dispersion machine equipped with circulating pass, "CLEARMIX" (produced by M Technique Ltd.), whereby dispersion liquid was prepared.

Polymerization initiator solution prepared by dissolving 11 parts by mass of polymerization initiator (KPS) in 240 parts by mass of ion-exchanged water was added to the above described dispersion liquid, then they were heated with stirring at 85° C. for 2 hours, and Dispersion Liquid [A2] of resin particles was prepared.

(3) Third Step Polymerization

Monomer Solution [3] composed of 450 parts by mass of styrene, 125 parts by mass of n-butylacrylate, and 8 parts by mass of n-octylmercaptan was prepared. Polymerization initiator solution prepared by dissolving 10 parts by mass of polymerization initiator (KPS) in 200 parts by mass of ion-exchanged water into Dispersion Liquid [A2] of resin particles, and Monomer Solution [3] was dripped under the temperature condition of 85° C. After completion of addition, they were heated with stirring for 3 hours, then cooled to 28° C., and Dispersion Liquid [A1] of Resin Particles [A1] having a plural layer structure was prepared. Resin Particles [A1] had a volume based median diameter of 160 nm, a glass transition point of 40° C., a softening point of 91° C., a storage elastic modulus at 100° C. of $9.5\times10^3$ dyn/cm$^2$, and a weight average molecular weight (Mw) of 20,000. Herein the glass transition point, the softening point, the storage elastic modulus and the weight average molecular weight (Mw) were respectively measured by the above described methods. These are common to the followings.

Step (a-2): Preparation of Dispersion Liquid [C] of Resin Particles [C] for Shell Layer In a 5 L reaction vessel equipped with a stirring unit, a temperature sensor, a cooling pipe and a nitrogen gas inlet, surfactant aqueous solution of 2 parts by mass of an anionic surfactant sodium dodecylsulfate (SDS) dissolved in 2,900 parts by mass of ion-exchanged water was prepared. Temperature of the surfactant aqueous solution was raised to 80° C. under while stirring at 230 rpm under a nitrogen gas flow. After dripping 9 parts by mass of polymerization initiator (KPS) in the surfactant aqueous solution, a monomer solution composed of 516 parts by mass of styrene, 204 parts by mass of n-butylacrylate, 100 parts by mass of methacrylic acid and 22 parts by mass of n-octylmercaptan was dripped for 3 hours, then the liquid temperature was maintained at 78° C. for one hour. A solution of 0.7 parts by mass of a surfactant (EMAL E-27C, produced by Kao Corp.) dissolved in 4 parts by mass of ion-exchanged water was added to the cooled resin dispersion liquid, and Dispersion Liquid [C] of Resin Particles [C] for shell layer was prepared. The Resin Particles [C] had a volume based median diameter of 90 nm, and the resin of Resin Particles [C] had a glass transition point of 50° C., a softening point of 111° C., and weight average molecular weight (Mw) of 11,000.

Step (b): Preparation of Dispersion Liquid [B1] of Resin Particles [B1]

In a 5 L reaction vessel equipped with a stirring unit, a temperature sensor, a cooling pipe and a nitrogen gas inlet, surfactant aqueous solution was charged preliminarily, and the temperature was raised to 80° C. while stirring at 230 rpm under a nitrogen gas flow. The surfactant solution was composed of 2.1 parts by mass of an anionic surfactant (SDS) and about 1,550 parts by mass of ion-exchanged water.

After adding 15 parts by mass of polymerization initiator (KPS) to the surfactant solution, a monomer solution composed of 195 parts by mass of n-butylacrylate, 60 parts by mass of itaconic acid and 945 parts by mass of methylmethacrylate was dripped for 3 hours, after completion of addition, they were kept at 78° C. for 1 hour, and Dispersion Liquid [B1] of Resin Particles [B1] was prepared. Resin Particles [B1] had a volume based median diameter of 90 nm, a glass transition point of 65° C., a softening point of 188° C., a storage elastic modulus at 100° C. of $5.0\times10^7$ dyn/cm$^2$ and a weight average molecular weight (Mw) of 300,000.

Step (c): Preparation of Dispersion Liquid [X] of Coloring Agent Microparticles

To a solution of 90 parts by mass of sodium dodecylsulfate dissolved in 1,600 parts by mass of ion-exchanged water while stirring, 29 parts by mass of coloring agent C.I. Pigment Blue 15 (copper phthalocyanine compound) was added gradually. Subsequently, Dispersion Liquid [X] of coloring agent microparticles in which coloring agent microparticles were prepared by dispersion process by employing a mechanical dispersion machine, "CLEARMIX" (produced by M Technique Ltd.). Volume based median diameter of the coloring agent microparticles was 110 nm.

Step (d): Aggregation and Fusion of Resin Particles [A1] and Resin Particles [B1]

In a reaction vessel equipped with a stirring device, a temperature sensor and a cooling pipe 390 parts by mass of Dispersion Liquid [A1] (solid substance converted amount) of Resin Particles [A1], 46 parts by mass of (solid substance converted amount) Dispersion Liquid [B1] of Resin Particles [B1], 1,700 parts by mass of ion-exchanged water and 150 parts by mass of coloring agent microparticles Dispersion Liquid [X] were poured and stirred. To the solution 25% by parts of aqueous sodium hydroxide solution was added to adjust pH of 10 to 10.3.

Subsequently, 120 parts by mass of aqueous solution of magnesium chloride hepta hydrate (50% by parts) was added for 20 minutes while stirring. Then it was heated to 75 to 80° C. taking about 60 minutes. Particle diameter of the particles growing in the reaction vessel was measured via MULTISIZER III (produced by Beckman Coulter Inc.), and 100 parts by mass of aqueous solution of sodium chloride (25% by parts) was added at a time the particle diameter reached to 6.5 mm to terminate the growing particle diameter. Thereafter, Dispersion Liquid [1] of aggregated particles [1] which were to be core of the toner was obtained by heating with stirring at 78° C. for 2 hours.

Step (e): Shelling Step

Subsequent to forming Core Part [1], 26 parts by weight of Dispersion Liquid [C] (solid substance converted amount) of Resin Particles [C] for shell layer was added taking 20 minutes at liquid temperature of 83° C. Stirring was continued for 2 hours after addition and Resin Particles [C] for shell layer was aggregated and fused on Core Part [1], to form a shell layer.

Step (f): Ripening Step

Subsequent to forming the shell layer, 200 parts by mass of sodium chloride aqueous solution (25% by parts) was added to terminate aggregation and fusion of microparticles of resin for forming shell. Thereafter, ripening process was carried out by continuing heating and stirring at liquid temperature of 88° C. for 2 hours.

Step (g) and Step (h): Washing and Drying Steps

Particle dispersion liquid formed in Step (f) was cooled at a ratio of 4° C./min., then the particles were washed with ion-exchanged water at 20° C., and dried at room temperature, and Toner [1] composed of Toner Particles [1] was prepared.

Example 2

Toner [2] composed of Toner Particles [2] was prepared in the same way as in Example 1, except that Dispersion Liquid [B1] of Resin Particles [B1] in the Step (d) was replaced by 138 parts by mass (solid substance converted amount) of Dispersion Liquid [B2] of Resin Particles [B2], and amount of Dispersion Liquid [A1] and ion-exchanged water were changed to 298 parts by mass of (solid substance converted amount), and 1,695 parts by mass, respectively.

Step (b): Preparation of Dispersion Liquid [B2] of Resin Particles [B2]

In a 5 L reaction vessel equipped with a stirring unit, a temperature sensor, a cooling pipe and a nitrogen gas inlet, surfactant aqueous solution was charged preliminarily, and the temperature was raised to 80° C. while stirring at 230 rpm under a nitrogen gas flow. The surfactant solution was composed of 1.5 parts by mass of an anionic surfactant sodium dodecylsulfate (SDS) and about 1,550 parts by mass of ion-exchanged water.

After adding 15 parts by mass of polymerization initiator (KPS) to the surfactant solution, a monomer solution composed of 195 parts by mass of n-butylacrylate, 60 parts by mass of itaconic acid and 945 parts by mass of methylmethacrylate was dripped for 3 hours, after completion of addition, they were kept at 78° C. for 1 hour, and Dispersion Liquid [B2] of Resin Particles [B2] was prepared. A volume based median diameter, a glass transition point, a softening point, a storage elastic modulus at 100° C. and a weight average molecular weight (Mw) of Resin Particles [B2] are shown in Table 1.

Example 3

Toner [3] composed of Toner Particles [3] was prepared in the same way as Example 1, except that Dispersion Liquid [B1] of Resin Particles [B1] used in the Step (d) was replaced with Dispersion Liquid [B3] of Resin Particles [B3], and mass of Dispersion Liquid [A1] and Dispersion Liquid [B3] ion-exchanged water were 413 parts by mass of (solid substance converted amount) and 23 parts by mass of (solid substance converted amount), respectively.

Step (b): Preparation of Dispersion Liquid [B3] of Resin Particles [B3]

In a 5 L reaction vessel equipped with a stirring unit, a temperature sensor, a cooling pipe and a nitrogen gas inlet, surfactant aqueous solution was charged preliminarily, and the temperature was raised to 80° C. while stirring at 230 rpm under a nitrogen gas flow. The surfactant solution was composed of 3.6 parts by mass of an anionic surfactant sodium dodecylsulfate (SDS) and about 1,550 parts by mass of ion-exchanged water.

After adding 15 parts by mass of polymerization initiator (KPS) to the surfactant solution, a monomer solution composed of 195 parts by mass of n-butylacrylate, 60 parts by mass of itaconic acid and 945 parts by mass of methylmethacrylate dripped for 3 hours, after completion of addition, they were kept at 78° C. for 1 hour, and Dispersion Liquid [B2] of Resin Particles [B2] was prepared. Volume based median diameter, glass transition point, softening point, storage elastic modulus at 100° C. and weight average molecular weight (Mw) of Resin Particles [B2] are shown in Table 1. A volume based median diameter, a glass transition point, a softening point, a storage elastic modulus at 100° C. and a weight average molecular weight (Mw) of Resin Particles [B3] are shown in Table 1.

Example 4

Toner [4] composed of Toner Particles [4] was prepared in the same way as Example 1, except that ripening time in Step (e) was changed to 5.5 hours.

Example 5

Toner [5] composed of Toner Particles [5] was prepared in the same way as Example 1, except that ripening time in Step (e) was changed to 1 hour.

Example 6

Toner [6] composed of Toner Particles [6] was prepared in the same way as Example 1, except that Dispersion Liquid [B4] of Resin Particles [B4] was used in place of Resin Dispersion Liquid [B1] of Particles [B1].

Step (b): Preparation of Dispersion Liquid [B4] of Resin Particles [B4]

In a 5 L reaction vessel equipped with a stirring unit, a temperature sensor, a cooling pipe and a nitrogen gas inlet, surfactant aqueous solution was charged preliminarily, and the temperature was raised to 80° C. while stirring at 230 rpm under a nitrogen gas flow. The surfactant solution was composed of 3.6 parts by mass of an anionic surfactant sodium dodecylsulfate (SDS) and about 1,550 parts by mass of ion-exchanged water.

After adding 15 parts by mass of polymerization initiator (KPS) to the surfactant solution, a monomer solution composed of 168 parts by mass of n-butylacrylate, 60 parts by mass of itaconic acid and 972 parts by mass of methylmethacrylate dripped for 3 hours, after completion of addition, they were kept at 78° C. for 1 hour, and Dispersion Liquid [B4] of Resin Particles [B4] was prepared. A volume based median diameter, a glass transition point, a softening point, a storage elastic modulus at 100° C. and a weight average molecular weight (Mw) of Resin Particles [B4] are shown in Table 1.

Example 7

Toner [7] composed of Toner Particles [7] was prepared in the same way as Example 1, except that Dispersion Liquid [A2] prepared by changing addition amount n-octylmercaptan to 3.87 parts by mass in the Second Step Polymerization in Step (a) in place of Dispersion Liquid [A1] of Resin Particles [A1].

Comparative Example 1

Comparative Toner [8] composed of comparative Toner Particles [8] was prepared in the same way as Example 1, except that ripening time of Step (e) was changed to 8 hours.

Comparative Example 2

Comparative Toner [9] composed of comparative Toner Particles [9] was prepared in the same way as Example 1, except that ripening time of Step (e) was changed to 0.5 hours.

Comparative Example 3

According to Example 8 of JP-A 2008-26645

In a 5 L reaction vessel equipped with a stirring unit, a temperature sensor, a cooling pipe and a nitrogen gas inlet, surfactant aqueous solution was charged preliminarily, and the temperature was raised to 80° C. while stirring at 230 rpm under a nitrogen gas flow. The surfactant solution was composed of 2.7 parts by mass of an anionic surfactant (SDS) and about 2,800 parts by mass of ion-exchanged water. On the other side, monomer solution was prepared by mixing 30 parts by mass of styrene, 30 parts by mass of methylmethacrylate, 33 parts by mass of n-butylacrylate, 40 parts by mass of maleic acid, and 14 parts by mass of n-octylmercaptan, and dissolved by heating to 78° C. The above described monomer solution and heated surfactant solution were mixed and dispersed via a mechanical dispersing machine having circulating pass, and emulsified particles having homogeneous dispersion particles diameter were prepared. Subsequently, solution dissolving 11.0 parts by mass of polymerization initiator (KPS) in 400 parts by mass of ion-exchanged water was added, and Resin Particle Dispersion Liquid [B5] was obtained by heating and stirring at 78° C. for 2 hours.

Comparative Toner [10] composed of comparative Toner Particles [10] was prepared in the same way as Example 1, except that Dispersion Liquid [B5] of Resin Particles [B5] was used in place of Dispersion Liquid [B1] of Resin Particles [B1] in Step (d), and ripening time in step (e) was changed to 0.5 hours.

TABLE 1

| | | Matrix | | | | | |
|---|---|---|---|---|---|---|---|
| | Toner No. | Dispersion Liquid No. | Median diameter of Resin Particles A (nm) * | Tg (° C.) | Tsp (° C.) | Mw | Storage elastic modulus at 100° C. (dyn/cm$^2$) |
| Example 1 | 1 | A1 | 160 | 40 | 91 | 20,000 | $9.5 \times 10^3$ |
| Example 2 | 2 | A1 | 160 | 40 | 91 | 20,000 | $9.5 \times 10^3$ |
| Example 3 | 3 | A1 | 160 | 40 | 91 | 20,000 | $9.5 \times 10^3$ |
| Example 4 | 4 | A1 | 160 | 40 | 91 | 20,000 | $9.5 \times 10^3$ |
| Example 5 | 5 | A1 | 160 | 40 | 91 | 20,000 | $9.5 \times 10^3$ |
| Example 6 | 6 | A1 | 160 | 40 | 91 | 20,000 | $9.5 \times 10^3$ |
| Example 7 | 7 | A2 | 155 | 45 | 98 | 27,000 | $1.0 \times 10^5$ |
| Comparative Example 1 | 8 | A1 | 160 | 40 | 91 | 20,000 | $9.5 \times 10^3$ |
| Comparative Example 2 | 9 | A1 | 160 | 40 | 91 | 20,000 | $9.5 \times 10^3$ |
| Comparative Example 3 | 10 | A1 | 160 | 40 | 91 | 20,000 | $9.5 \times 10^3$ |

| | | Domain | | | | | | | |
|---|---|---|---|---|---|---|---|---|---|
| | Toner No. | Dispersion liquid No. | Median diameter of Resin Particles B (nm) ** | Tg (° C.) | Tsp (° C.) | Mw | Storage elastic modulus at 100° C. (dyn/cm$^2$) | Content ratio to whole binding resin (% by parts) | Ripening time (H) |
| Example 1 | 1 | B1 | 90 | 65 | 188 | $3.0 \times 10^5$ | $5.0 \times 10^7$ | 10 | 2 |
| Example 2 | 2 | B2 | 140 | 65 | 190 | $3.0 \times 10^5$ | $5.1 \times 10^7$ | 30 | 2 |
| Example 3 | 3 | B3 | 44 | 65 | 178 | $3.0 \times 10^5$ | $4.9 \times 10^7$ | 5 | 2 |
| Example 4 | 4 | B1 | 90 | 65 | 188 | $3.0 \times 10^5$ | $5.0 \times 10^7$ | 10 | 5.5 |
| Example 5 | 5 | B1 | 90 | 65 | 188 | $3.0 \times 10^5$ | $5.0 \times 10^7$ | 10 | 1 |
| Example 6 | 6 | B4 | 90 | 70 | 195 | $3.5 \times 10^5$ | $1.0 \times 10^8$ | 10 | 2 |
| Example 7 | 7 | B1 | 90 | 65 | 188 | $3.0 \times 10^5$ | $5.0 \times 10^7$ | 10 | 2 |
| Comparative Example 1 | 8 | B1 | 90 | 65 | 188 | $3.0 \times 10^5$ | $5.0 \times 10^7$ | 10 | 8 |
| Comparative Example 2 | 9 | B1 | 90 | 65 | 188 | $3.0 \times 10^5$ | $5.0 \times 10^7$ | 10 | 0.5 |
| Comparative Example 3 | 10 | B5 | 100 | 60 | 96 | $8.0 \times 10^4$ | $8.5 \times 10^5$ | 10 | 3 |

* Volume based median diameter of Resin Particles A

** Volume based median diameter of Resin Particles B

Evaluation

Developers [1] to [10] were manufactured by blending each of obtained Toners [1] to [10] with ferrite carrier coated with cyclohexylmethacrylate resin having volume based median diameter of 60 μm via V-type blender, so as to have toner density 6% by mass. The following evaluation was carried out employing these developers [1] to [10].

Toner particles [1] to [10] were observed via an atomic force microscope (AFM) SPM(SPI3800N) (produced by Seiko Instruments Inc.) in Viscoelastic AFM Image mode and it was confirmed that a binding resin had a domain-matrix structure. A number ratio of domains having Length L in the range of 60 to 500 nm, a number ratio of domains having Width Win the range of 45 to 100 nm, an arithmetic mean value of ratio (L/W), an arithmetic mean value of area S of the obtained Viscoelastic AFM Image having 2 μm square obtained by the atomic force microscope (AFM) were shown in Table 2. Herein, ratio (L/W) of Length L to Width W, an arithmetic mean value ratio (L/W) and an arithmetic mean value of area S were measured and calculated by methods described above.

(1) Evaluation of Glossiness

Developer [1] to [10] were respectively installed in a composite machine bizhub PRO C6501 (produced by Konica Minolta Business Technologies, Inc.) available from the market as an image forming apparatus, and a solid image having a toner amount of 1.2 mg/cm$^2$ was formed in which surface temperature of a heating device in a thermal roller fixing type of fixing device was set as 150° C., under the normal temperature and humidity conditions (temperature 20° C., humidity 50% RH), on a transferee material "POD GLOSS-COAT (128 g/m$^2$)" (produced by Oji paper Co., Ltd.). Glossiness of the solid image was measured and evaluated according to the following evaluation criteria. Glossiness of 60% or higher is acceptable.

The glossiness was measured, taking a standard of glass surface having refraction index of 1.567 and angle of incidence of 75°, employing a gloss meter (GIVIX-203, produced by Murakami Color Research Laboratory Co., Ltd.).

Evaluation Criteria

Excellent: Glossiness is 70% or higher.

Good: Glossiness is not lower than 60% and not higher than 70%.

No good: Glossiness is lower than 60%.

(2) Evaluation of Hot Off-Set

Developer [1] to [10] were respectively installed in a composite machine bizhub PRO C6501 (produced by Konica Minolta Business Technologies, Inc.) available from the market as an image forming apparatus. Surface temperature of a heating device in a thermal roller fixing type of fixing device was varied each 5° C. at higher than 100° C., and fixing test was carried out with respect to the following items at each temperature, under the normal temperature and humidity conditions (temperature 20° C., humidity 50% RH).

(1) Nan Hot Off-Set Region

First, a stripe shape of solid image of 5 cm width perpendicular to conveying direction was fixed by conveying crosswise on A4 size coated paper "POD Gloss Coat (84.9 g/m$^2$)" (produced by Oji paper Co., Ltd.), and temperature A which is the lower limit of fixing temperature, was confirmed by generation of hot off-set phenomena or not. Subsequently, a stripe shape of solid image having 5 mm width perpendicular to conveying direction and a half tone image having width of 20 mm were fixed by conveying crosswise on A4 size coated paper "POD Gloss Coat (84.9 g/m$^2$)" (produced by Oji paper Co., Ltd.), and temperature B at which roughness of the image surface or thermal roller stains due to hot off-set phenomena were observed was confirmed, and the difference between temperature B and lower limit temperature A was evaluated as fixing temperature region, that is, non hot off-set region, according to the following criteria. Non hot off-set region of 65° C. or higher is acceptable.

Evaluation Criteria

Excellent: Non hot off-set region is 80° C. or higher.

Good: Non hot off-set region is not lower than 65° C. and not higher than 80° C.

No good: Non hot off-set region is lower than 65° C.

(II) Low Temperature Fixing Property

A stripe shape of solid image of 5 cm width perpendicular to conveying direction was fixed by conveying crosswise on coated paper "mondi 300 (300 g/m$^2$)" (produced by Mondi), temperature C, that is lower limit fixing temperature, was confirmed by generation of hot off-set phenomena or not. The lower limit temperature C 155° C. or lower is acceptable.

TABLE 2

| | | | Domain | | | | Evaluation | | |
|---|---|---|---|---|---|---|---|---|---|
| | | | | | | | | Hot off-set Property | |
| | Toner No. | Toner Tsp (° C.) | Ratio of number of domains having length L in the rage of 60 to 500 nm (number %) | Ratio of number of domains having width W in the rage of 45 to 140 nm (number %) | Arithmetic mean value of ratio (L/W) | Arithmetic mean value of area S (μm$^2$) | Glossiness (%) | Non hot off-set region (° C.) | Low temperature fixing property (° C.) |
| Example 1 | 1 | 103 | 100 | 100 | 2.9 | 0.0339 | 73 | 85 | 150 |
| Example 2 | 2 | 104 | 100 | 95 | 2.9 | 0.0447 | 61 | 75 | 155 |
| Example 3 | 3 | 102 | 95 | 92 | 3.0 | 0.0084 | 76 | 71 | 145 |
| Example 4 | 4 | 104 | 93 | 100 | 5.0 | 0.0585 | 60 | 90 | 160 |
| Example 5 | 5 | 101 | 87 | 100 | 1.5 | 0.0176 | 76 | 75 | 155 |
| Example 6 | 6 | 105 | 82 | 100 | 3.0 | 0.051 | 67 | 85 | 145 |
| Example 7 | 7 | 105 | 93 | 100 | 3.0 | 0.0351 | 61 | 85 | 165 |
| Comparative Example 1 | 8 | 104 | 78 | 100 | 1.3 | 0.152 | 72 | 50 | 150 |
| Comparative Example 2 | 9 | 100 | 100 | 77 | 5.2 | 0.0608 | 56 | 65 | 165 |
| Comparative Example 3 | 10 | 93 | Impossible to measure | Impossible to measure | — | — | 67 | 60 | 160 |

The invention claimed is:

1. A toner tor developing an electrostatic image comprising a toner particle containing a binding resin, wherein, in a viscoelastic image of a cross section of the toner particle observed via an atomic force microscope, the binding resin has a domain-matrix structure composed of a high elastic resin composing a domain and a low elastic resin composing a matrix, an arithmetic mean value of ratio (L/W) of the Length L, to Width W of the domains is 1.5 to 5.0, and domains having Length A in the range of 60 to 500 nm exist 80 number % or more, and domains having Width W in the range of 45 to 100 nm exist 80 number % or more, a glass transition point of the high elastic resin composing the domain is 60 to 80° C., and a glass transition point of the low elastic resin composing the matrix is 25 to 50° C.

2. The toner of claim 1, wherein an arithmetic mean value of each area S of domains is 0.005 to 0.05 $\mu m^2$.

3. The toner of claim 1, wherein a softening point of the toner is 90 to 110° C.

4. The toner of claim 1, wherein a softening point of the toner is 95 to 105° C.

5. The toner of claim 1, wherein an arithmetic mean value of each area S of domains is 0.01 to 0.05 $\mu m^2$.

6. The toner of claim 1, wherein a storage elastic modulus of the high elastic resin at 100° C. is $4.0 \times 10^5$ to $1.0 \times 10^8$ $dyn/cm^2$.

7. The toner of claim 1, wherein a storage elastic modulus of the low elastic resin at 100° C. is $1.0 \times 10^2$ to $1.0 \times 10^4$ $dyn/cm^2$.

8. The toner of claim 1, wherein the toner particle contain a coloring agent.

9. the toner of claim 1, wherein the high elastic resin composing the domain is a styrene-acryl resin or a (meth) acrylic acid ester copolymer.

10. The toner of claim 1, wherein the high elastic resin composing the domain is a (meth)acrylic acid ester copolymer.

11. The toner of claim 10, wherein the (meth)acrylic acid ester copolymer is a copolymer of methylmethacrylate, butylacrylate and itaconic acid.

12. The toner of claim 1, wherein the glass transition point of the high elastic resin composing the domain is 63 to 68° C.

13. The toner of claim 1, wherein a softening point of the high elastic resin composing the domain is 150 to 200° C.

14. The toner of claim 13, wherein the softening point of the high elastic resin composing the domain is 170 to 180° C.

15. The toner of claim 1, wherein the glass transition point of the low elastic resin composing a matrix is 30 to 40° C.

16. The toner of claim 1, wherein a softening point of the low elastic resin composing a matrix is 80 to 120° C.

17. The toner of claim 16, wherein a softening point of the low elastic resin composing a matrix is 90 to 100° C.

* * * * *